United States Patent [19]

Burton, Jr.

[11] Patent Number: 4,886,005

[45] Date of Patent: Dec. 12, 1989

[54] THREAD UNDERCUT ATTACHMENT FOR A MULTI-NEEDLE SEWING MACHINE

[75] Inventor: Gene Burton, Jr., Healdton, Okla.

[73] Assignee: Atlanta Attachment Company, Lawrenceville, Ga.

[21] Appl. No.: 128,426

[22] Filed: Dec. 3, 1987

[51] Int. Cl.[4] ..... D05B 27/14; D05B 65/02

[52] U.S. Cl. ..... 112/292; 112/166; 112/255; 112/262.1; 112/301

[58] Field of Search ..... 242/147 R; 112/291, 112/292, 301, 295, 255, 239, 197, 166, 262.1, 163, 298, 294, 296, 297

[56] References Cited

U.S. PATENT DOCUMENTS

| | | | |
|---|---|---|---|
| 1,013,252 | 1/1912 | Wood . | |
| 2,968,269 | 1/1961 | Smith et al. . | |
| 3,139,849 | 7/1964 | Cohen et al. . | |
| 3,359,933 | 12/1967 | Bono . | |
| 3,532,065 | 10/1970 | Marforio | 112/292 |
| 3,648,634 | 3/1972 | Van Hazendonk | 112/292 |
| 3,804,043 | 4/1974 | Benson et al. | 112/275 |
| 4,303,030 | 12/1981 | Palacino et al. . | |
| 4,421,045 | 12/1983 | Portilla . | |
| 4,459,925 | 7/1984 | Miyachi et al. | 112/294 X |
| 4,461,229 | 7/1984 | Angele et al. | 112/291 |
| 4,558,654 | 12/1985 | Schilling et al. . | |

FOREIGN PATENT DOCUMENTS

| | | | |
|---|---|---|---|
| 2165186 | 8/1973 | Fed. Rep. of Germany | 112/295 |
| 716849 | 10/1966 | Italy | 242/147 R |
| 61-52894 | 3/1986 | Japan | 112/116 |

*Primary Examiner*—Andrew M. Falik
*Attorney, Agent, or Firm*—Thomas & Kennedy

[57] ABSTRACT

A thread undercut attachment for use on multi-needle sewing machines uses a single piston actuated cutting blade which passes through the sewing area beneath the workpiece and above the loopers. To prevent the needles and loopers from becoming unthreaded or to prevent undue lengths of thread after cutting, apparatus is provided for creating a measured amount of slack in the threads leading to the needles and loopers, and then holding the threads firmly to prevent further payout of thread when the workpiece is pulled toward the operator.

20 Claims, 2 Drawing Sheets

FIG. 1
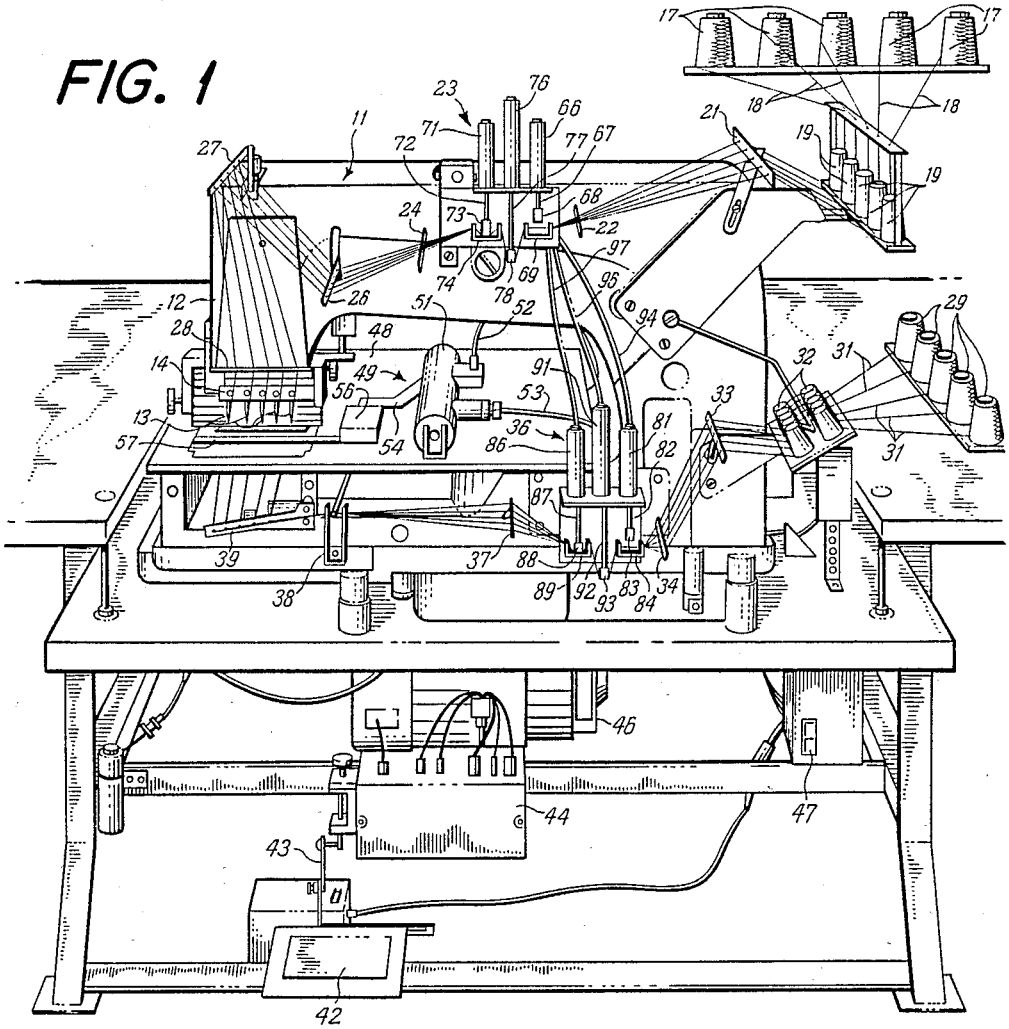
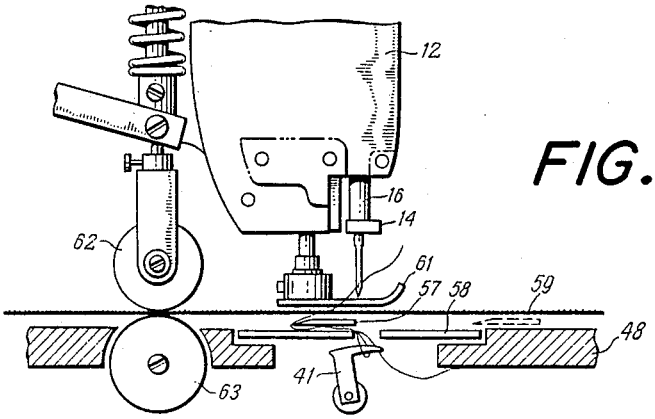
FIG. 2

THREAD UNDERCUT ATTACHMENT FOR A MULTI-NEEDLE SEWING MACHINE

BACKGROUND OF THE INVENTION

This invention relates to method and apparatus for cutting multiple threads in a single, controlled step on a work product being sewn by a multi-needle sewing machine.

The use of multi-needle sewing machines for simultaneously forming a plurality of rows of stitches in a work piece materially reduces the amount of time involved in completing various work products. Such multi-needle operation does create problems, however. For example, when the work piece having several rows of stitches is completed, the operator is required to delay commencing a new sewing operation while the multiple threads extending from both the needles and the loopers of the machines are cut, usually by hand. It is also difficult for the operator to cut the threads expeditiously by hand, since it is generally necessary to pull the work product out of the machine and to cut the threads with scissors. Such manual operation wastes time and thread, since the operator usually must pull the work product too far out of the machine in order to see and reach the threads, resulting in either the lengths of thread at the needles and loopers being too long, or the threads of thread hanging from the finished work product being too long.

Heretofore, various types of automated thread cutters for mechanically cutting the threads extending from the needles and loopers have been developed. Prior art multiple thread cutters often require individual cutting members for each thread, as shown in U.S. Pat. No. 3,139,849 of Cohen et al, which are integral with the sewing machine itself, thus requiring machines especially built for specific applications. Still others, as exemplified in U.S. Pat. No. 3,532,065 of Marforio, act to pull the threads to be cut out of the sewing area, thus creating, at least in some cases, unnecessarily long lengths of thread.

Many prior art arrangements are limited with respect to the number of threads that can be cut; some require that the needles be staggered so that separate cutting elements can be applied to individual threads, and, as in the case of the Cohen et al arrangement, many are not adapted for use on a variety of machine configurations. Another characteristic of many prior art devices is the use of two cutters, one for cutting the needle threads, the other for cutting the looper threads, which at least in some arrangements, can only be done at the end of the work piece, and not at some intermediate point.

SUMMARY OF THE INVENTION

The present invention is an improved method and apparatus for cutting multiple threads extending from the work piece to both the needle and the loopers and employs a single cutting member for cutting both sets of threads. When the machine operator finishes sewing a work piece, or when for any reason it is desired to cut the threads, the foot operated control pedal, which in addition to its normal operating positions has a cut position is moved to the cut position by the operator. As a result, a motion control stops the needles in their raised position and the presser foot of the machine is raised.

At the same time, thread slack units are activated to create slack in the threads extending to the needles and to the loopers, and then to hold the threads from the spools firmly. The operator pulls the work piece backwards away from the stitching area until the slack in the threads is removed and the threads are taut. When the threads are taut, a cutting member located beneath the work piece and above the loopers is driven forward, cutting the threads from both the needles and the loopers.

It is, therefore, an object of the present invention to provide an improved method and apparatus for cutting multiple threads extending from a work piece to the needles and loopers of a multi-needle sewing machine with a cutting blade by moving the cutting blade forward beneath the work piece to cut all of the threads at the same time.

It is another object of this invention to provide an improved method and apparatus for controlling the length of the threads being cut in a multiple needle sewing machine by activating thread puller feet to create slack in the threads extending to the needles and the loopers and then engaging and holding the threads with thread brakes to hold the threads taut when the operator pulls back on the work product, enabling a cutter to cut all of the threads in a single stroke.

Still another object of the invention is to provide an improved method and apparatus for cutting with a thread cutter multiple threads from a work piece being sewn by a multi-needle sewing machine leaving enough thread extending from the needles and loopers of the sewing machine so that the needles and loopers remain threaded for the next sewing operation.

It is still another object of the present invention to provide an attachment for a multi-needle sewing machine, with the attachment enabling the operator to cut the threads extending from the needles and loopers to the work piece by pulling the work piece rearwardly while actuating a cutting means which simultaneously cuts all the threads in one cutting operation.

Other objects, features, and advantages of the present invention will become apparent from the following detailed description read in conjunction with the accompanying drawings.

DESCRIPTION OF THE DRAWINGS

FIG. 1 is a front perspective view of a multi-needle sewing machine equipped with a thread cutter attachment;

FIG. 2 is a side elevation view showing the action of the cutter blade in the needle area.

DETAILED DESCRIPTION

Figure 3:
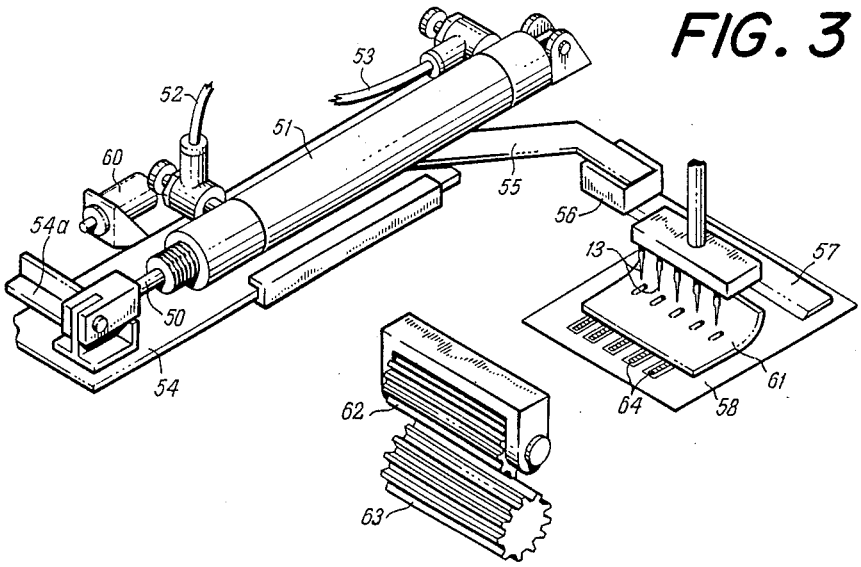
FIG. 3 is a perspective view of the cutting blade and the actuating mechanism therefor.

Turning to FIG. 1, there is shown a sewing machine 11 having a head portion 12 from which extends a plurality of aligned sewing needles 13 mounted to needle drive plate 14 and shaft 16 (FIG. 2). A plurality of spools 17 of thread 18 are located adjacent the machine 11 and supply thread 18 to a plurality of creels or tensioning devices 19. From the creels 19 the threads pass through a first thread guide 21, a second thread guide 22, through a thread braking and pulling assembly 23, which will be discussed more fully hereinafter, a third guide 24, a tensioning guide 26, and through fourth and fifth thread guides 27 and 28 to needles 13.

The looper thread supply is basically similar to the needle thread supply, and comprises a plurality of spools 29 of thread 31 located adjacent the machine. From the spools the treads 31 pass through creels 32, and first and second thread guides 33. From guide 34 the threads 31 pass through a thread braking and pulling assembly 36, thread guide 37, thread tensioning member 38, and thread guide 39 to loopers 41 (FIG. 2). As thus far described, the arrangement of FIG. 1 is a standard multi-needle type sewing machine except for thread braking and pulling assemblies 23 and 36, and guides 22, 24 and 34, 37, which will be explained more fully hereinafter.

Control of the machine 11 is through an operator actuated control pedal 42 which is connected by a crank assembly 43 to a control box 44. Control box 44 controls drive motor 46 and also the various elements of the thread cutting components of the present invention. The entire mechanism is turned on and off by a suitable switch 47.

Mounted on the bed 48 of the machine 11 is the cutting mechanism 49 of the present invention.

As illustrated in FIG. 3, cutting mechanism 49 (FIG. 1) comprises a cylinder and piston assembly 51 which can be either hydraulically or pneumatically operated through fluid or air supply conduits 52, 53. Piston rod 50 reciprocates slide plate 54 which carries laterally extending blade support arm 55, blade support block 56 and thread cutting blade 57. Pilot valve 60 is actuated by the extension 54a of slide plate 54 during the reciprocation of the cutting blade 57. It can be seen in FIG. 2 that blade 57 is located above bed 48 and throat plate 58 but below the work piece 59 and presser foot 61. Also shown in FIG. 2 are feed rollers 62 and 63 which function to pull the work piece 59 through the sewing area and keep it aligned properly. Feed dogs 64 (FIG. 3), also function to feed the work piece 59 through the sewing area. Feed dogs are standard equipment on most sewing machines.

In FIG. 2, thread cutting blade 57 is shown in dashed outline in its normal position in front of the needles where it stays during the sewing operation and is also shown in solid line in its cutting position. In FIG. 3, the blade 57 is shown in its normal position.

Returning to FIG. 1, upper thread braking and pulling assembly 23 comprises a first brake or nipper cylinder and piston 66 which may be either pneumatically or hydraulically actuated. A piston rod extension 67 has a foot 68 mounted on its free end adapted to fit within a U-shaped plate 69. As can be seen in FIG. 1, threads 18 pass over the upturned ends of plate 69 and beneath shoe 68. When the piston and cylinder unit 66 is actuated, shoe 68 is driven down against threads 18, pressing them firmly against plate 69, thereby effectively braking the threads. Assembly 23 also includes a second brake or nipper cylinder and piston 71, extended piston rod 72, foot 73, and plate 74, which function in the same manner as the elements of the first brake. Situated between brake elements 66 and 71 is a thread puller cylinder and piston 76, having an extended piston rod 77 with a foot 78 mounted on the free end thereof. When cylinder and piston unit 76 is actuated, foot 78 presses down against thread 18 to create slack in the threads extending between brake foot 73 and creels 19.

Lower thread braking and pulling assembly 36 is virtually identical to upper assembly 23, operating on the looper threads 31 in the same manner as assembly 23 operates on needle threads 18. Assembly 36 comprises a first brake unit having a cylinder and piston unit 81, extended piston rod 82, foot 83, and plate 84. A second brake unit comprises cylinder and piston unit 86, extended piston rod 87, foot 88, and plate 89. Between units 81 and 86 is located puller cylinder and piston unit 91 having extended rod 92 and foot 93. Fluid conduits 94, 96, and 97 supply actuating fluid to units 81, 86, and 91, respectively. While both assemblies 23 and 36 have been shown and discussed as either pneumatically or hydraulically actuated, it is also possible that they be solenoid operated. In addition, no fluid supply, either hydraulic or air, has been shown, inasmuch as such elements are of standard design and their operation is well known.

It can readily be seen that the thread cutting unit 49 and brake and pulling units 23 and 36 are not integral parts of the sewing machine 11 but are readily attachable thereto. Together these elements constitute a thread cutting assembly readily attachable to a variety of sewing machines.

OPERATION

During normal sewing operation, none of the piston units of assemblies 23, 36 and 49 is actuated, the cutting blade 57 is in its normal position as shown in FIG. 3, and feet 68, 73, 78, 83, 88, and 93 are in the raised position, out of contact with threads 18 and 31. When the sewing operation is completed, or when, for any reason the operator wishes to cut the threads, the operator moves the foot pedal 42 (FIG. 1) to the cutting position. A motion control means in the control box 44 connected to the control pedal 42 by a control rod 43 and linkage, engages upon movement of the control pedal 42 and elevates the needles 13, 15 and the presser foot 61 away from the workpiece 59. Such a control means is standard equipment on most machines, and examples are described in U.S. Pat. Nos. 3,590,969 and 3,804,043. Immediately thereafter piston units 71 and 86 are actuated, braking the thread to the needles and loopers. While the threads are thus braked, thread puller units 76 and 91 are actuated, pushing down on the threads and creating slack in the threads between the actuated brakes 71 and 86 and the creels. As soon as the threads are depressed to from slack in the treads, as shown in FIG. 1, brake units 66 and 81 are actuated, braking the threads, and brake units 71 and 86 are released, leaving a loop of slack in the thread extending from the actuated brake to the needles and to the loopers.

When the slack has been formed in both needle and looper threads, the operator pulls back on the work piece, pulling the slack from the threads to both the needles and loopers, and the cutter piston unit is actuated, causing the cutter blade 57 to pass through the sewing area and cut the threads coming from both the needles and the loopers, leaving both needles and loopers still threaded. One of the purposes for creating slack in the threads just prior to cutting is to insure that there will be sufficient thread to avoid unthreading either the needles or the loopers and to insure that a sufficient length of threads remains on the work product.

The timing of the various steps is controlled by the control box, and can be varied to suit the operator. However, the sequence remains the same.

Although a single, straight edge cutting blade 57 has been illustrated and described for the purpose of cutting the threads extending from the work product, other thread cutters can be substituted for the blade, if desired. For example, a serrated blade or a pair of reciprocatable serrated blades can be used, or other cutters of relatively flat configuration can be used with can pass beneath the work product.

The foregoing has been a description of the invention in a preferred embodiment thereof. Numerous modifications, additions, or deletions may readily occur to workers in the art without departure from the spirit and scope of the invention.

I claim:

1. An attachment for a multi-needle sewing machine of the type for forming parallel stitches in a work product including a thread supply, a plurality of reciprocable needles and loopers receiving threads from the thread supply, a throat plate, and a presser foot, said attachment comprising a continuous edge cutting member of a length sufficient to span the positions of all of the threads extending from the loopers and needles of the sewing machine to the work product for positioning in front of the needles of the multi-needle sewing machine and the workpiece to be fed to the needles of the sewing machine, cutting member moving means operably connected to said cutting member for moving said cutting member longitudinally from in front of the reciprocable needles of the sewing machine through the area beneath the needles and the presser foot and beneath the workpiece and above the throat plate and the loopers of the sewing machine, whereby when the sewing operation has terminated the work product is moved away from the needles and the cutting member moves into simultaneous cutting contact with all of the threads extending through the workpiece from the needles and the threads extending from the workpiece to the loopers.

2. The attachment as claimed in claim 1 and further including a first thread braking and pulling means for creating slack in the threads running from the thread supply to the needles and including means for holding the threads taut when the workpiece is moved away from the needles so that when slack has been created in the threads by the first thread braking and pulling means the work piece is moved by the operator away from the needles and loopers until the slack is depleted and the threads are held taut by the braking means and the cutting member is moved by the cutting member moving means to sever the taut threads.

3. The attachment as claimed in claim 2 and further including a second thread braking and pulling means for creating slack in the threads running from the thread supply to the loopers and including means for holding the threads taut when the workpiece is pulled from the sewing area, so that when slack has been created in the threads by the second thread braking and pulling means the workpiece is moved by the operator away from the needles and loopers until the slack is depleted and the threads are held taut by the braking means and the cutting member is moved by the cutting member moving means to sever the taut threads.

4. The attachment as claimed in claim 1 wherein the cutting member comprises a single horizontal free moving cutting blade with a straight sharpened edge, and said cutting member moving means for moving said cutting member longitudinally beneath the reciprocable needles and presser foot and beneath a workpiece comprises a fluid actuated cylinder including a piston connected to said cutting blade and arranged to move the sharpened edge of said cutting blade into substantially simultaneous cutting engagement with the threads extending from the workpiece to the needles and loopers of the sewing machine at an attitude so that all the threads are cut at approximately the same length from the needles and from the loopers of the sewing machine.

5. For use on a multi-needle sewing machine having a plurality of reciprocable needles and loopers for forming multiple rows of stitches in a work product passing between said needles and loopers, a first and second thread control means for controlling the movement of threads from thread supplies to the needles and loopers respectively of the sewing machine when threads extending from the needles and loopers to the work product are to be cut, each of said thread control means including a first and second thread braking member and a thread pulling member for pulling thread from the supplies of thread toward the sewing machine, each of said first thread braking members including a braking foot and a braking plate and each of said second thread braking members including a braking foot and a braking plate, each of said thread pulling members located between each of said first and second thread braking members and including a thread pulling foot, and a multiple thread cutter arranged to simultaneously cut the threads extending from multiple rows of stitches in the work product toward the loopers and needles of the sewing machine, whereby the first braking member of each thread control means clamps threads against its braking plate and the thread pulling foot engages and pulls threads from the supplies of threads to form slack in the threads, then the second braking member of each thread control means clamps threads against its braking plate and the first braking member releases threads and the slack in the threads is pulled through the needles and loopers by moving the workpiece before the thread cutter cuts the threads.

6. The thread control means as claimed in claim 5 wherein each of said thread braking members and each of said thread pulling members comprises a fluid actuated cylinder and piston and includes a fluid piston rod to which said foot is attached.

7. A multiple thread cutter attachment for use with a multiple needle sewing machine of the type including a plurality of reciprocated co-acting needles and loopers, thread supply means for supplying threads to each of the needles and loopers, and a throat plate positioned above the loopers for receiving the needles whereby a workpiece is moved from in front of the needles along a path extending beneath the needles and over the throat plate and over the loopers as the needles and loopers reciprocate to form stitches in the workpiece, said thread cutter attachment comprising:

cutting means for mounting to the sewing machine in front of the needles, means for moving said cutting means form in front of the needles beneath the needles and the workpiece and over the throat plate and over the loopers of the sewing machine into cutting contact with threads extending from the workpiece toward the throat plate, and thread control means for holding the threads extending from the thread supply means to the needles and loopers taut as the cutting means is moved into cutting contact with the threads.

8. The multiple thread cutter attachment as claimed in claim 8 and wherein said thread control means comprises first and second thread control means, each of said thread control means comprising thread pulling means for creating a measured amount of slack in the threads extending from the thread supply means to the needles and to the loopers of the sewing machine, and brake means for preventing additional thread being drawn to the needles and loopers so that when slack has been created in the threads extending to the needles and to the loopers and the brake means have been actuated the work piece is free to move away from the needles and loopers until the threads are taut and the cutting means is moved to sever the taut threads.

9. The multiple thread cutter attachment as claimed in claim 8 wherein said means for moving said cutting means and each of said thread pulling means and said brake means comprises a fluid actuated cylinder and piston.

10. A method of cutting threads extending from the needles and loopers of a multiple needle sewing machine to the workpiece sewn by the machine comprising the steps of terminating the sewing operation of the machine with the needles and presser foot raised from the workpiece, pulling additional lengths of needle and looper threads from the source of supply of the threads, pulling the workpiece away from the needles, moving a cutting member beneath the workpiece in a direction opposed to the direction that the workpiece is pulled and engaging and cutting with the cutting member the threads extending from the workpiece toward the loopers of the sewing machine.

11. A method of cutting threads as claimed in claim 10 and further including the step of preventing additional lengths of needle thread from being pulled from the source of supply of the needle threads while the workpiece is being pulled away from the needles.

12. A method of cutting threads as claimed in claim 11 and further including the step of preventing additional lengths of looper thread from being pulled from the source of supply of the looper threads while the workpiece is being pulled away from the loopers.

13. A method of cutting threads as claimed in claim 12 and further including the step of preventing thread from being pulled from the needles while additional lengths of thread are being pulled from the source of supply of the needle threads.

14. A method of cutting threads as claimed in claim 13 and further including the step of preventing thread from being pulled from the loopers while additional lengths of thread are being pulled from the source of supply of the looper threads.

15. A thread cutter attachment for use with a multiple needle sewing machine of the type including a plurality of reciprocable sewing needles and loopers, a throat plate covering the loopers and for receiving the needles as they reciprocate and thread supply means for supplying individual threads to each of the needles and loopers, and means for moving workpieces from in front of the needles along a path beneath the needles and over the throat plate so that multiple rows of stitches are formed in the workpieces, said thread cutter attachment comprising:

a thread cutter including a cutting edge of a continuous length sufficient to span all of the threads extending from the needles and loopers to the workpieces, means for movably mounting said thread cutter to a sewing machine of the type described in a position in front of the needles and above the throat plate, said means for movably mounting said thread cutter to the sewing machine, including means for moving said thread cutter from in front of the needles along a path beneath the needles and over the throat plate and beneath the workpiece sewn by the sewing machine with is cutting edge moving into cutting contact with threads extending from the workpiece toward the throat plate.

16. The thread cutter attachment of claim 15 and wherein said thread cutter comprises a straight edge cutting blade with a cutting edge extending at a right angle with respect to the direction of movement of said thread cutter from in front of the needles of the sewing machine along the path beneath the needles of the sewing machine.

17. The thread cutter attachment of claim 15 and wherein said means for moving said thread cutter comprises a fluid operated cylinder and piston assembly operably attached to said thread cutter for reciprocating said thread cutter over the throat plate of the sewing machine.

18. The thread cutter attachment of claim 16 and further including thread movement control means for mounting adjacent the sewing machine and including means for advancing predetermined lengths of threads from the thread supply means to the sewing machine upon each operation of said thread cutter attachment whereby predetermined lengths of threads are advanced to the sewing machine and the work product is moved away from the sewing machine until the threads become taut and the thread cutter is moved beneath the workpiece into cutting contact with the threads extending from the work product toward the throat plate.

19. A thread cutter attachment for use with a multiple needle sewing machine of the type including a plurality of reciprocable sewing needles and loopers, a throat plate positioned beneath the needles for receiving the ends of the needles one each reciprocation of the needles, feed means for advancing a workpiece over the throat plate and means for supplying threads to the needles and loopers, said thread cutter attachment comprising:

a thread cutting member with a single flat sharpened thread cutting edge of an effective length great enough to span all of the threads extending from the needles and loopers of the sewing machine to the workpiece, means for movably mounting said thread cutting member to the sewing machine adjacent the throat plate to one side of the needles of the sewing machine with the sharpened thread cutting edge of the thread cutting member facing the needles, said means for mounting said thread cutting member to the sewing machine including means for moving said thread cutting member over the throat plate and beneath the needles of the sewing machine and beneath a workpiece extending over the throat plate whereby the sharpened thread cutting edge of the thread cutting member engages and cuts the threads extending from the workpiece toward the throat plate.

20. The thread cutter attachment of claim 19 and wherein said thread cutting member is sized, shaped and oriented to engage and cut substantially simultaneously the threads extending from the workpiece toward the throat plate.

* * * * *